United States Patent [19]

Van Sickler

[11] Patent Number: 4,679,126

[45] Date of Patent: Jul. 7, 1987

[54] MINIATURE LAMP ARRAYS HAVING IMPROVED LAMP RETENTION FEATURES

[75] Inventor: Robert H. Van Sickler, South Euclid, Ohio

[73] Assignee: General Electric Company, Schenectady, N.Y.

[21] Appl. No.: 820,774

[22] Filed: Jan. 21, 1986

[51] Int. Cl.[4] ..... H01R 33/00

[52] U.S. Cl. ..... 362/226; 362/237; 362/806

[58] Field of Search ..... 362/226, 236, 237, 249, 362/353, 452, 806

[56] References Cited

U.S. PATENT DOCUMENTS

| | | | |
|---|---|---|---|
| 4,228,486 | 10/1980 | Matsuya | 362/237 |
| 4,234,915 | 11/1980 | Malinowski et al. | 362/806 |
| 4,241,387 | 12/1980 | Bowers | 362/252 |
| 4,318,158 | 3/1982 | Livermore et al. | 362/226 |
| 4,471,414 | 9/1984 | Savage | 362/226 |
| 4,599,682 | 7/1986 | Stephens | 362/191 |

*Primary Examiner*—Craig R. Feinberg
*Assistant Examiner*—David A. Okonsky
*Attorney, Agent, or Firm*—John P. McMahon; Philip L. Schlamp; Fred Jacob

[57] ABSTRACT

A decorative string set used for Christmas lighting is disclosed. The string set comprises various embodiments of clamping means which provide positive retention of incandescent lamps to their respective electrical sockets.

15 Claims, 4 Drawing Figures

MINIATURE LAMP ARRAYS HAVING IMPROVED LAMP RETENTION FEATURES

BACKGROUND

This invention relates to a decorative string set comprised of a plurality of incandescent lamps which plug into complementary sockets along the string set. More particularly, the invention relates to a Christmas tree string set having means which clamp the connection of the lamps to their complementary sockets.

In the past, a variety of constructions have been used to electrically interconnect, in a serial manner, the incandescent lamps of decorative string sets. One such construction is disclosed in U.S. Pat. No. 4,241,387 of H. J. Bowers, which is assigned to the same assignee as the present invention.

A major problem inherent with a serially connected decorative string set is that if any one of the incandescent lamps becomes loosened or removed from their complementary electrical sockets during handling or use, the serial connection is interrupted and the string set becomes inoperative. Loosening of one or more lamps during use is especially troublesome for sets used outdoors, because the effects of wind and vibration can more easily cause the lamps to loosen. While lamps can be secured in their sockets by many different methods, such as by using a metal screw thread base for the lamp, the manufacturing costs for doing such securing are very critical, since the decorative string set product is meant to be produced and sold on a very cost competitive basis. It is desired that a relatively simple means for positive lamp retention or clamping the electrical connection of the lamps to the string set be provided.

A desired feature for the decorative string set that may be used in both indoors and outdoors, are attachments formed into the string set itself and serving as branch clips. These branch clips provide the means for a stationary position of the string set by affixing to the tree located indoor or outdoors. It is desired that the string set be provided with such branch clips but in a relatively inexpensive manner. Further, it is desired that these branch clips be incorporated into the clamping means so as to provide both functions in a relatively inexpensive manner.

In view of the foregoing, it is therefore an object of the present invention to provide a string set having means for positive retention or clamping the electrical connection of the lamps to their complementary electric sockets.

Another object of the present invention is to provide a string set having branch clips which are formed as an integral part of the clamping means.

A further object of the present invention is to provide the clamping means, and the branch clips incorporated into the clamping means, in a manner so as to minimize the cost of the fabrication of the string set itself.

SUMMARY OF THE INVENTION

This invention is directed to a decorative string light having means for clamping the connection of the incandescent lamps to their complementary sockets formed along the string set itself.

The decorative string set comprises a plurality of incandescent lamps, each having lead-in wires and a plug-in base having an upper rim portion, and a plurality of housing spaced along the decorative string having affixed therein electrical sockets for complementary acceptance and respective connections to said lead-in wires of said incandescent lamps. The string set further comprises means for clamping the connection of the lamps to their sockets.

In one embodiment, the clamping means comprises at least one boss formed into the housing. The clamping means further comprises a light transmissive device, preferably of the ornamental type, having at least one keyway at its opened-bottom portion with complementary dimensions relative to the at least one boss. The device has a lower portion with a ridge having complementary dimensions relative to the rim of the incandescent lamp. The ornamental device is effective such that when it is placed over the lamp and down onto the housing, and then rotated the at least one keyway mate with and frictionally engages the at least one boss so that the lamp is clamped in its electrical socket.

In the second embodiment, the clamping means comprises at least one cavity formed into housing. The clamping means further comprise an arrangement having at least one arm having complementary dimensions relative to the at least one cavity. The arrangement has an opening sufficient to allow the arrangement to fit over the incandescent lamp. The arrangement has a lower portion with complementary dimensions relative to the rim of the incandescent lamp. The arranagement is positioned onto the housing such that at least one arm frictionally engages at least one cavity so that the lamp is clamped in its electrical socket.

DETAILED DESCRIPTION OF THE PREFERRED EMBODIMENT

Figure 1:
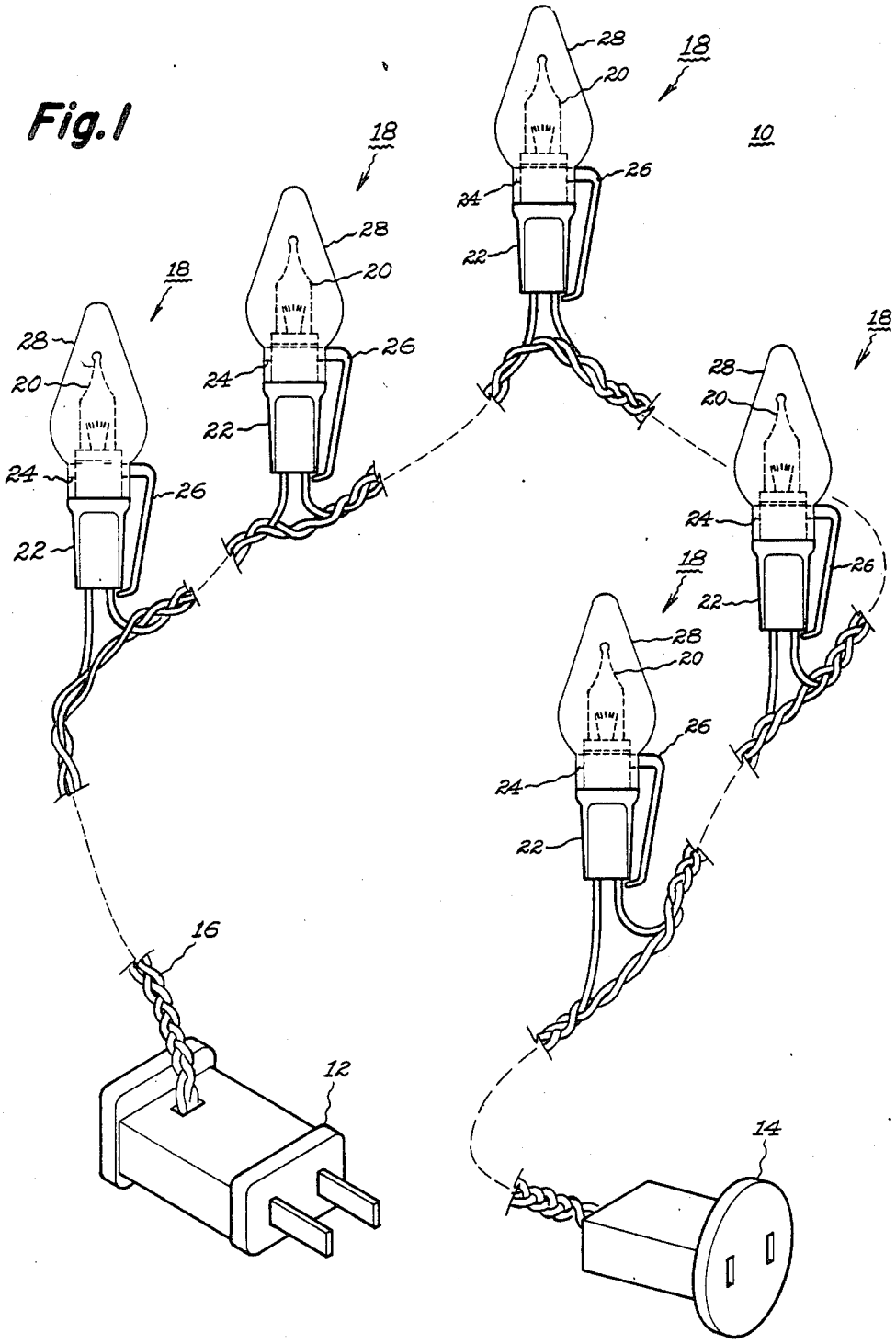
FIG. 1 illustrates a decorative string set in accordance with one embodiment of the present invention.

FIG. 1 illustrates decorative string set 10 in accordance with one embodiment of the present invention. The string set 10 comprises a plug 12 located at one end for insertion into a convenient electric socket so as to apply excitation to the string set 10. String set 10 also has a connector 14 allowing for interconnections to other string sets such as that shown in FIG. 1. The lamps of the string set 10 are interconnected by a plurality of wire segments shown in FIG. 1 as comprising a power conductor 16. The lamps of string set 10 are serially connected such as those used for decorative lighting during holidays.

The decorative string set 10 comprises a plurality of incandescent lamps, each having lead-in wires and a plug-in base having an upper rim portion. The string set further comprises a plurality of housing spaced along the decorative string set, and having affixed therein, electrical sockets for complementary acceptance and respective connection to the lead-in wires of the incandescent lamp. The string set 10 further has means, to be discussed hereinafter in detail, for clamping the connection between the lamps and their complementary sockets.

In FIG. 1, the string set has a plurality of lighting arrangements 18 which comprises a miniature incandescent lamp 20 (shown in phantom) which is positioned into a housing 22 (partially shown in phantom). In one embodiment, the clamping means of the string set is provided by an outward protrusion or boss 24 and a portion of the branch clip 26, all formed into the housing 22 having affixed therein the electrical socket which mates with the incandescent lamp 20. The clamping means further comprises a light transmissive device 28 preferably of an ornamental type, and has a spherical shape along with at least one keyway (not shown in FIG. 1) with complementary dimensions relative to the boss protrusion 24 and a portion of the branch clip 26. The clamping means of FIG. 1 is shown in more detail in FIG. 2.

The incandescent lamp 20 is affixed within an associated plug-in base 30, preferably formed of a thermoplastic material, and having an upper rim portion 32. The incandescent lamp 20 has lead-in wires 34 and 36 which extend out of and along the sides of base 30.

The indancescent lamp 20 is inserted into the housing 22, preferably formed of a thermoplastic material, so that lead-in wires 34 and 36 respectively make mechanical and electrical contact with terminals 38 and 40 which are connected to appropriate wires of the conductor 16. The housing 22 having the boss 24 also has a portion $26_A$ of the branch clip 26.

The electrical contacts of the incandescent lamp 20 and terminals of housing 22, without the benefits of the present invention, are suspectible to become interrupted. As discussed in the "Background" section this interruption may be created by handling the string set 10 or by wind and vibration effects. The clamping means of the present invention eliminates this interruption problem and may be discussed with regard to device 28 of FIG. 2.

The ornamental device 28 has a bottom portion having keyways 42 and 44 and a ridge portion 46 located on its inner surface. The device 28 preferably has a plurality of ventilation aperatures $28_A$ located at top portion of the device 28 and aperatures $28_B$ located at the bottom portion of the device 28 each of which allows ventilation to prevent excessive temperatures from being created within the confines of device 28 and also allows drainage of any water that may find its way into the confines of 28. The bottom portion has an opening sufficient to allow device 28 to be positioned over the lamp 20. The keyways 42 and 44 have dimensions, such as their opening and depth or thickness, which are respectively complementary to the boss 24 and the portion $26_A$ both of housing 22. The dimensions of ridge 46 is complementary to that of the upper rim 32 of the incandescent lamp 20.

In the practice of one embodiment of the clamping means of the present invention, the device 28 is positioned over the lamp 20 and down until the ridge 46 engages with the rim 32. The device 28 is then positioned and pressed down so that the passageways of keyways 42 and 44 respectively mate with boss 24 and portion $26_A$. The device 26 is then rotated so that boss 24 and portion $26_A$ are frictionally engaged within the confines of keyways 42 and 44. This frictional engagement clamps the electrical contacts between the lamp 20 and the terminals of housing 22 so as to eliminate the interruption problem previously discussed.

Although the previous discussion described the useage of a boss 24 and portion $26_A$, it should be realized that only one such device is necessary. Similarly, the device 28 need only have one keyway. If only one device is utilized on the housing 22, it is preferred that the portion $26_A$ be used and further it is preferred that this boss incorporate the branch clip itself. Further, the complementary dimensions between the keyways 42 and 44 may be interchanged with either boss 24 or portion $26_A$. For all such arrangements it is only necessary that the device 26 be locked onto the housing 22 so as to provide the clamping means.

Figure 2:
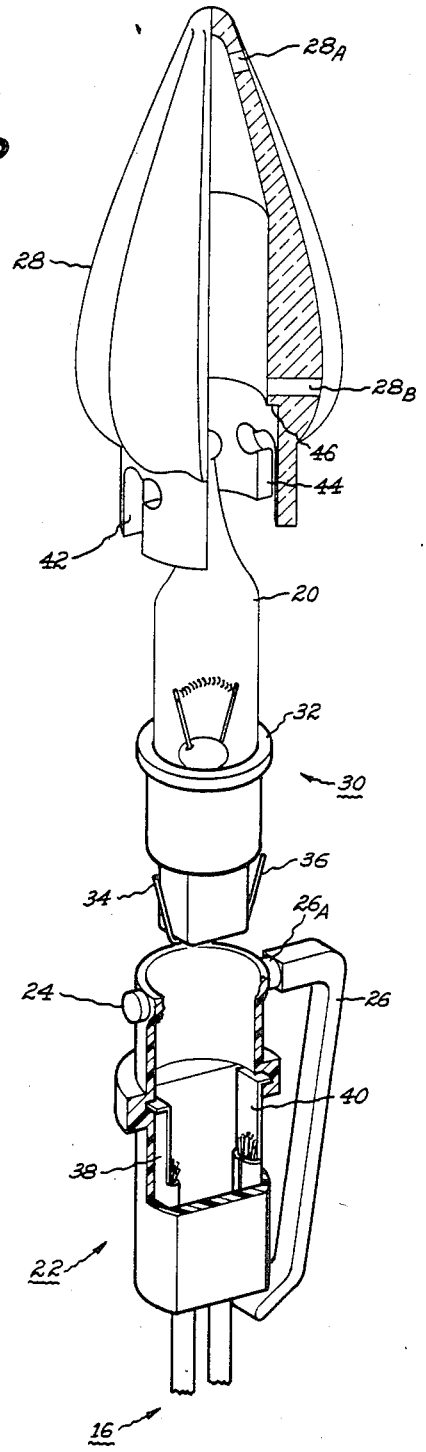
FIG. 2 illustrates an incandescent lamp along with one embodiment of the clamping means of the present invention.
Figure 3:
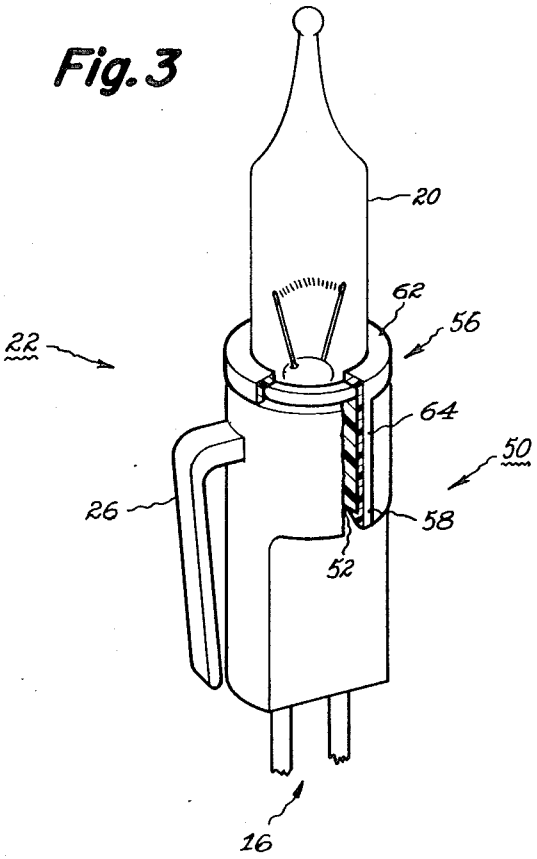
FIG. 3 illustrates another clamping means in accordance with the present invention.
Figure 4:
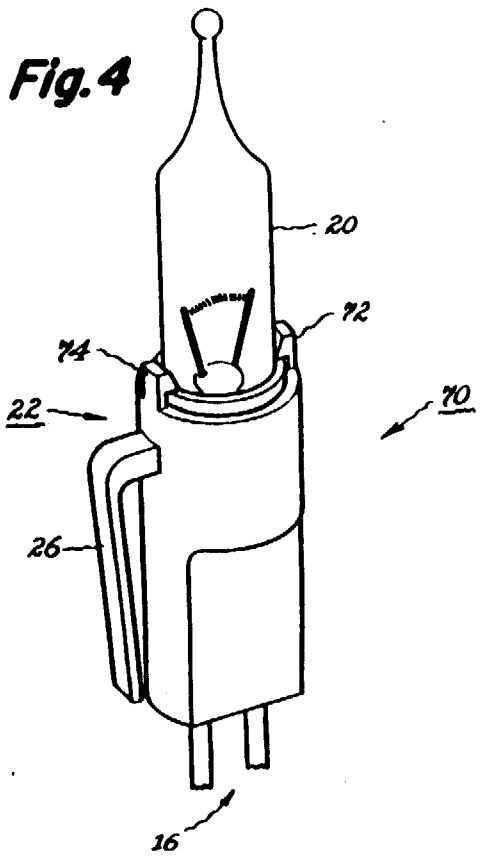

The second embodiment of the clamping means 50 of the present invention is illustrated in FIG. 3. The clamping means of FIG. 3 comprises at least one cavity 52 formed into the housing 22 which housing 22, previously discussed with regard to FIG. 2, preferably has a branch clip 26. It is preferred that housing 22 have a second cavity 54 (not shown) diametrically located relative to the first cavity 52 and having dimensions similar to cavity 52.

The clamping means 50 of FIG. 3 further has an arrangement 56, preferably formed of a thermoplastic material, and having at least one arm 58 having complementary dimensions relative to the first cavity 52. It is preferred that arrangement 56 have a second arm 60 (not shown) located diametrically opposite arm 58 and with complementary dimensions relative to cavity 54. The arrangement 56 has a bottom portion 62 having complementary dimensions relative to the upper rim 32 of the lamp 20.

The bottom portion 62, the arm 58, and the cavity 52 are all partially shown in FIG. 2 as cut-away so as to expose the mating of arm 58 to the cavity 52. The arm 58 has a lower portion with a tip which frictionally engages into the cavity 52.

The arrangement 56 has an opening sufficient to allow the arrangement 56 to fit over the incandescent lamp and for portion 62 to contact rim 32. The arms 58 and 60 are then positioned onto the housing 28 such that the arms 58 and 60 frictionally engage the cavities 52 and 54 so that the lamp 20 is clamped within the electrical socket of the housing 22 in a manner similar to that described with regard to FIG. 2.

For the clamping means of FIG. 3, it is preferred that the housing 22 further comprise a pair of channels 64 (located under arm 58) and 66 (not shown) formed into the housing and coaxially and respectively arranged with respect to the cavities 52 and 54 of the housing 22. The channels 64 and 66 provide a path for accepting the arms 58 and 60 and assist in the positioning of the arms 58 and 60 so as to fit into and frictionally engage the cavities 52 and 54.

Figure 4:
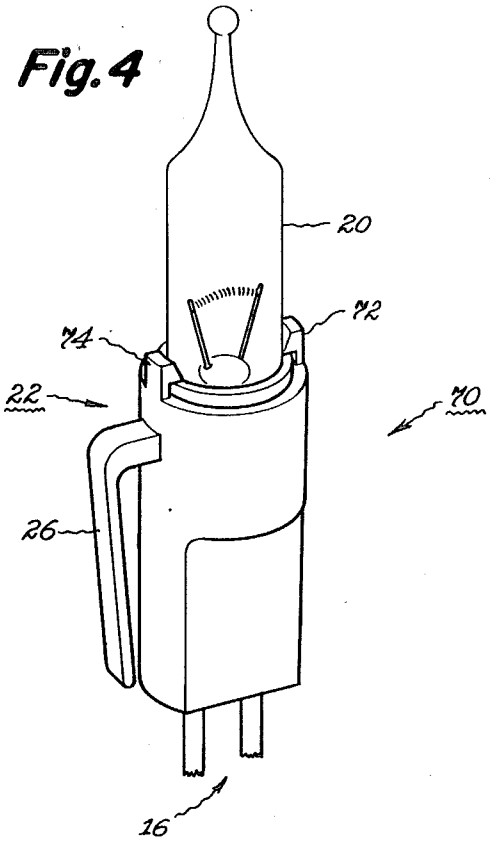
FIG. 4 illustrates a further clamping means in accordance with another embodiment of the present invention.

The practice of the present invention contemplates various other clamping means, similar to that discussed with regard to FIG. 3, that may be realized by various configuration of the housing 22 one of which arrangement 70 is shown in FIG. 4. The arrangement 70 has at least one tab member 72, but preferably another 74, each with dimensions which allow the tab members 72 and 74 to frictionally engage the rim portion of the incandescent lamp. Such an engagement being effective to cause the lead-in wires of the lamp 20 to be clamped into their electrical contact with the terminals of the housing 22.

It should now be appreciated that the practice of the present invention provides a decorative string set having simple but effective clamping means of that described with regard to FIGS. 3 and 4. Further, the string set has a branch clip formed as an integral part of the housing itself to allow the stationary position of the string set on to the devices of which the set may be attached such as trees. The string set may also be provided with a clamping means such as that discussed with regard to FIG. 2 in which the branch clip forms an integral part of the clamping means itself.

What I claim is:

1. A decorative string set comprising;
(a) a plurality of incandescent lamps, each having lead-in wires and a plug-in base having an upper rim;
(b) a plurality of housings spaced along said decorative stiring set, said housings having affixed therein electrical sockets providing a first means for complementary acceptance and respective connection to said lead-in wires of said incandescent lamps;
(c) a separate means for locking the connection of said lamps having said plug-in base to said sockets.

2. A decorative string set in accordance to claim 1 wherein said housing, said plug-in base having said upper rim, and said locking means are all formed of a thermoplastic material.

3. A decorative string set comprising:
(a) a plurality of incandescent lamps, each having lead-in wires and a plug-in base having an upper rim;
(b) a plurality of housings spaced along said decorative string set, said housings having affixed therein electrical sockets for complementary acceptance and respective connection to said lead-in wires of said incandescent lamps; and
(c) means for clamping the connection of said lamps having said plug-in base to said sockets, said clamping means comprising;
(a) a first boss formed into said housing; and
(b) a device formed of a light-transmissive material and having a first keyway with complementary dimensions relative to said boss, said device having a lower portion with a ridge having complementary dimensions relative to said rim of said incandescent lamp, said device being effective such that when positioned over said lamp and down onto said rim of said incandescent lamp and then pressed and rotated such that said keyway mate with and frictionally engages said first boss so that said lamp is clamped in said electrical socket.

4. A decorative string set according to claim 3 wherein said device is of an ornamental type.

5. A decorative string set according to claim 3 wherein said first boss comprises a portion of a branch clip.

6. A decorative string set according to claim 3 further comprising;
(a) a second boss, spaced apart from said first boss, and formed into said housing; and
(b) a second keyway of said device with complementary dimensions relative to said second boss, said device being effective such that when positioned over said lamp and down onto said upper rim of said incandescent lamp and then pressed and rotated said keyways mate with and frictionally engage said bosses so that lamp is clamped in said electrical socket.

7. A decorative string set in accordance with claim 3 wherein said device is formed of a plastic material.

8. A decorative string set in accordance with claim 3 wherein said housing, said plug-in base having said upper rim, and said clamping means are all formed of a thermoplastic material.

9. A decorative string set comprising:
(a) a plurality of incandescent lamps, each having lead-in wires and a plug-in base having an upper rim;
(b) a plurality of housings spaced along said decorative string set, said housings having affixed therein electrical sockets for complementary acceptance and respective connection to said lead-in wires of said incandescent lamps; and
(c) means for clamping the connection of said lamps having said plug-in base to said sockets, said clamping means comprising:
(a) a first cavity formed into said housing; and
(b) an arrangement having a first arm having complementary dimensions relative to said first cavity, said arrangement having an opening sufficient to allow the arrangement to fit over said incandescent lamp, said arrangement having a low portion with complementary dimensions relative to said rim of said incandescent lamp, said arrangement being positioned onto said upper rim of said incandescent lamp such that said first arm frictionally engages said first cavity so that said lamp is clamped in said electrical socket.

10. A decorative string set in accordance with claim 9 wherein said housing, said plug-in base having said upper rim, and said clamping means are all formed of thermoplastic material.

11. A decorative string set according to claim 9 further comprising;
(a) a second cavity spaced apart from said first cavity and formed into said housing; and
(b) a second arm of said arrangement with complementary dimensions relative to said second cavity, said arrangement being positioned onto said upper rim of said incandescent lamp such that said first and second arms respectively frictionally engage said first and second cavities so that said lamp is clamped in said electrical socket.

12. A decorative string set in accordance with claim 11 wherein said clamping means further comprises;
(a) a least a pair of channels formed into said housing coaxially and respectively arranged with said first and second cavities, said channels providing a path to accept said first and second arms and assisting respective positioning of said first and second arms into said first and second cavities.

13. A decorative string set comprising:
(a) a plurality of incandescent lamps, each having lead-in wires and a plug-in base having an upper rim;
(b) a plurality of housings spaced along said decorative string set, said housings having affixed therein electrical sockets for complementary acceptance and respective connection to said lead-in wires of said incandescent lamps; and
(c) means for clamping the connection of said lamps having said plug-in base to said sockets, said clamping means comprising;
(a) an arrangement formed into said housing comprising a tab member having dimensions effective to frictionally engage and clamp a portion of said rim of said incandescent lamp when said lamp is inserted into said housing.

14. A decorative string set according to claim 13 wherein said arrangement further comprises a second tab member with dimensions effective to frictionally engage and clamp a portion of said rim of said incandescent lamp when said lamp is inserted into said housing.

15. A decorative string set in accordance to claim 13, wherein said housing, said plug-in base having said upper rim, and said clamping means are all formed of a thermoplastic material.

* * * * *

REEXAMINATION CERTIFICATE (1563rd)

United States Patent [19]

[11] B1 4,679,126

Van Sickler

[45] Certificate Issued Oct. 1, 1991

[54] MINIATURE LAMP ARRAYS HAVING IMPROVED LAMP RETENTION FEATURES

[75] Inventor: Robert H. Van Sickler, South Euclid, Ohio

[73] Assignee: General Electric Company

Reexamination Request:
No. 90/002,289, Mar. 1, 1991

Reexamination Certificate for:

| | |
|---|---|
| Patent No.: | **4,679,126** |
| Issued: | **Jul. 7, 1987** |
| Appl. No.: | **820,774** |
| Filed: | **Jan. 21, 1986** |

[51] Int. Cl.[5] ..... H01R 33/00

[52] U.S. Cl. ..... 362/226; 362/237; 362/806

[58] Field of Search ..... 362/226, 236, 237, 249, 362/353, 452, 806

[56] References Cited

U.S. PATENT DOCUMENTS

| | | | |
|---|---|---|---|
| 804,387 | 11/1905 | Davis | 439/308 |
| 1,616,654 | 2/1927 | Gammeter | 439/356 |
| 1,905,843 | 4/1933 | Foulke | 315/32 |
| 2,462,530 | 2/1949 | Miller | 439/356 |
| 3,182,185 | 5/1965 | Ahroni | 240/10 |
| 3,671,923 | 6/1972 | Rieth | 339/93 |
| 4,228,486 | 10/1980 | Matsuya | 362/237 |
| 4,234,915 | 11/1980 | Malinowski et al. | 362/806 |
| 4,241,387 | 12/1980 | Bowers | 362/252 |
| 4,318,158 | 3/1982 | Livermore et al. | 362/226 |
| 4,471,414 | 9/1984 | Savage | 362/226 |
| 4,599,682 | 7/1986 | Stephens | 362/191 |
| 4,603,278 | 7/1986 | Devir et al. | 313/318 |
| 4,647,132 | 3/1987 | Mikola | 339/91 |

FOREIGN PATENT DOCUMENTS

| | | | |
|---|---|---|---|
| 2217179 | 8/1973 | Fed. Rep. of Germany | 33/46 |
| 940600 | 2/1971 | Japan . | |
| 109269 | 8/1979 | Japan | 33/10 |
| 6220282 | 2/1973 | Taiwan . | |
| 1055631 | 7/1967 | United Kingdom . | |
| 2105531 | 3/1983 | United Kingdom | 13/639 |

*Primary Examiner*—David A. Okonsky

[57] ABSTRACT

A decorative string set used for Christmas lighting is disclosed. The string set comprises various embodiments of clamping means which provide positive retention of incandescent lamps to their respective electrical sockets.

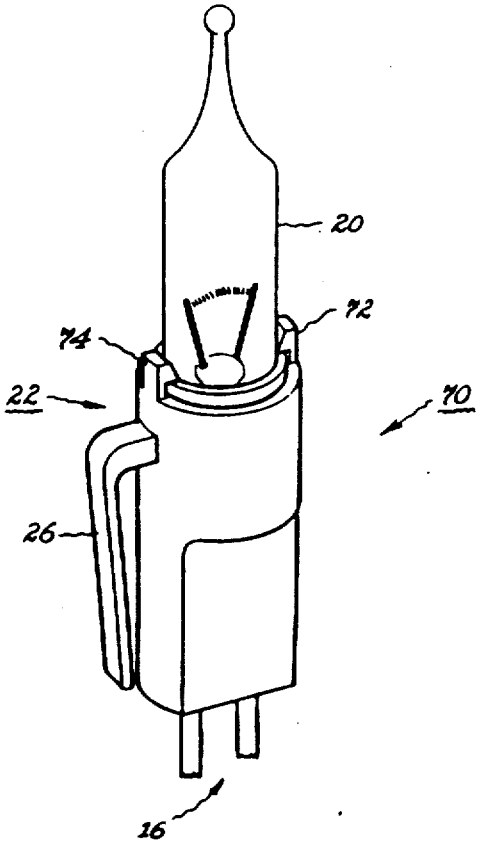

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 through 12 is confirmed.

Claim 13 is determined to be patentable as amended.

Claims 14 and 15, dependent on an amended claim, are determined to be patentable.

New claims 16 and 17 are added and determined to be patentable.

13. A decorative string set comprising:

(a) a plurality of incandescent lamps, each having lead-in wires and a plug-in base having an upper rim;

(b) a plurality of housings spaced along said decorative string set, said housings having affixed therein electrical sockets for complementary acceptance and respective connection to said lead-in wires of said incandescent lamps; and (c) means for [clamping] *locking* the connection of said lamps having said plug-in base to said sockets, said [clamping] *locking* means comprising:

(a) an arrangement formed into said housing comprising a tab member having dimensions effective to frictionally engage and [clamp] *positively retain* a portion of said rim of said incandescent lamp when said lamp is inserted into said housing.

*16. A decorative string set as set forth in claim 1 wherein said locking means is disengagable by an action other than that action required to remove said incandescent lamps from corresponding housings.*

*17. A decorative string set as set forth in claim 1 wherein said locking means includes a plurality of locking members cooperatively associated with at least some of said incandescent lamps and effective for engaging at least some of said housings such that at least some of said incandescent lamps are locked into said sockets, said locking members being engagable into said locked condition by an action independent of insertion of the incandescent lamp into the corresponding housing.*

* * * * *